United States Patent [19]

Riedl

[11] 4,312,685

[45] Jan. 26, 1982

[54] SURFACE HARDENING OF CAMS OF MOTOR-VEHICLE CAMSHAFTS

[75] Inventor: Volker Riedl, Ingolstadt, Fed. Rep. of Germany

[73] Assignee: Audi Nsu Auto Union Aktiengesellschaft, Neckarsulm, Fed. Rep. of Germany

[21] Appl. No.: 74,300

[22] Filed: Sep. 11, 1979

[30] Foreign Application Priority Data

Sep. 14, 1978 [DE] Fed. Rep. of Germany ..... 2839990

[51] Int. Cl.[3] ..... C21D 9/30

[52] U.S. Cl. ..... 148/146; 148/151; 148/152

[58] Field of Search ..... 148/146, 151, 152, 150

[56] References Cited

U.S. PATENT DOCUMENTS 3,231,434 1/1966 Seulen et al. ..... 148/150

FOREIGN PATENT DOCUMENTS

7702409[U] 1/1977 Fed. Rep. of Germany .

*Primary Examiner*—R. Dean

*Attorney, Agent, or Firm*—Karl F. Ross

[57] ABSTRACT

A cam of a camshaft has its surface hardened by rotating the camshaft about its axis while maintaining a TIG torch at a fixed spacing from the surface, and while relatively axially reciprocating the torch and the camshaft so the torch heats the surface along an undulating path. The pitch or crest-to-crest spacing of this path is maintained constant for uniform hardening either by varying the angular rotation rate of the camshaft or by varying the axial reciprocation frequency between the camshaft and torch. The radial spacing of the portion of the surface being heated at a given instant from the axis is measured to control the rotation or reciprocation rate.

5 Claims, 4 Drawing Figures

SURFACE HARDENING OF CAMS OF MOTOR-VEHICLE CAMSHAFTS

FIELD OF THE INVENTION

The present invention relates to a method of and an apparatus for hardening the cams of a motor-vehicle camshaft. More particularly this invention concerns an automatic system for zone-hardening the cam surfaces of such a camshaft.

BACKGROUND OF THE INVENTION

It is known to harden the surfaces of the cams of a valve-lifting camshaft for a motor-vehicle internal-combustion engine by passing a heat source over the surfaces. Normally as described in commonly owned U.S. patent applications Ser. Nos. 940,199 and 940,200 both filed Sept. 7, 1978 a tungsten-inert-gas (TIG) torch is used which is held adjacent the cam as the camshaft is rotated. In this manner a camshaft of grey cast iron can have its cam surfaces hardened to a high degree with relative ease.

It is also known from German utility model No. 7,702,409 filed Jan. 28, 1977 by the assignee of the instant application to axially relatively reciprocate the TIG torch and the camshaft as the camshaft is rotated, so that the torch heats the surface of the cam along an undulating path. This path is normally confined to the central two-thirds of the cam surface in accordance with the above-cited U.S. patent applications.

This German utility model also describes how the heat source constituted by the TIG torch is maintained at a fixed axial spacing from the cam surface it is acting on by means of a lathe-type motion-copying system. A master camshaft is held adjacent the camshaft to be hardened, and the two shafts are synchronously rotated about parallel axes, with the various lobes of the one shaft lying in predetermined angular positions to the lobes of the other shaft. A follower arrangement engaging the lobes of the cams of the master or template camshaft controls the radial displacement of the respective TIG torch so that same rests a slight distance off the respective camshaft. Such an arrangement allows the cam surfaces to be hardened accurately and with excellent production speed.

The disadvantage of this system is that the very locations on the cams which require the most hardening, that is the radially projecting lobes, often are hardened least effectively. This is due to the fact that these lobes pass more rapidly under the respective torch, since the angular rotation rate is constant and these lobes project radially further than the rest of the cams so that they pass more rapidly under the heat source. As a result the treatment of these projecting lobes is substantially less.

It has been suggested to overcome this disadvantage by using a relatively slow angular rotation speed or relatively high reciprocation frequency to ensure good hardening of even these lobes. The disadvangtage of this is that the amount of treatment time devoted to the rest of the cams is far in excess of what is needed, particularly since it is the lobes that are subject to the most wear on such a camshaft.

OBJECTS OF THE INVENTION

It is therefore an object of the present invention to provide an improved method of and apparatus for hardening an object having an axis and an eccentric surface.

Another object is to provide such a method particularly applicable to a camshaft for an internal-combustion engine.

Yet another object is to provide such a system which ensures a substantially uniform hardening over the entire eccentric surface of an object.

SUMMARY OF THE INVENTION

These objects are attained according to the instant invention in a method of the known type wherein the object is rotated about the axis at an angular speed rate and a heat source is juxtaposed with the surface of the object. The heat source and the object are relatively axially reciprocated as the object is rotated at a reciprocation rate so that the heat source heats the surface of the object along an undulating path. According to this invention one of these rates, that is the angular speed rate or the reciprocation rate, is varied in such a manner that the pitch of the path, or the crest-to-crest distance of the path, remains substantially constant.

According to this invention the one rate that is varied is varied generally in dependence on the instantaneous radial distance between the location juxtaposed with the heat source and the axis. Thus as the radial distance between the source and the axis increases either the angular rotation rate of the shaft is decreased or the reciprocation frequency is increased to ensure complete treatment of this region.

It is possible according to the instant invention merely to make the varied rate vary in dependence on the radial distance from the axis, or even simply to establish several different angular speeds or reciprocation speeds which are selectively employed in accordance with the instantaneous radial distance.

It has been found however that more accurate results are obtained when the slope of the surface being hardened relative to an imaginary plane perpendicular to a diametral plane through the location being hardened and through the axis is taken into account. Thus in the event of a sharp variation in the diameter the surface where the change in diameter occurs will be adequately surface-hardened.

More particularly in accordance with this invention the one speed or rate being varied is the angular velocity, and this is calculated in accordance with the following formula:

$$\omega i = (r_{min}/r_i)\omega_{min} \sin\gamma_i$$

wherein:

- $\omega_i$ is the instantaneous angular speed of the object about the axis;
- $r_{min}$ is the radius of the surface at its region of its smallest (minimum) radius;
- $r_i$ is the instantaneous radius from the location juxtaposed with the heat source;
- $\omega_{min}$ is the angular speed of the object when the source is juxtaposed with the region of smallest radius; and
- $\gamma_i$ is the instantaneous angle between a plane tangent to the surface at the location juxtaposed with the source and a plane through the location and the axis.

According to another feature of the instant invention the rate being varied is the relative axial reciprocation rate between the workpiece and the heat source. This frequency is established in accordance with the following formula:

$$f_i=(r_i/r_{min})f_{min}/\sin\gamma_i$$

wherein:

- $f_i$ is the instantaneous axial reciprocation frequency between the object and the source;
- $r_i$ is the instantaneous radius from the location juxtaposed with the heat source;
- $f_{min}$ is the axial reciprocation frequency of the object and the source when the source is juxtaposed with the region of smallest diameter; and
- $\gamma_i$ is the instantaneous angle between a plane tangent to the surface at the location juxtaposed with the source and a plane through the location and the axis.

With the system according to the instant invention it is therefore possible uniformly to harden the entire cam surface. Virtually no matter what shape the cam has the heat source will define an undulating path of substantially the same crest-to-crest spacing or pitch. The procedure is carried out entirely automatically, and indeed it is possible to carry it out on all of the cams of a single camshaft simultaneously.

SPECIFIC DESCRIPTION

Figure 1:
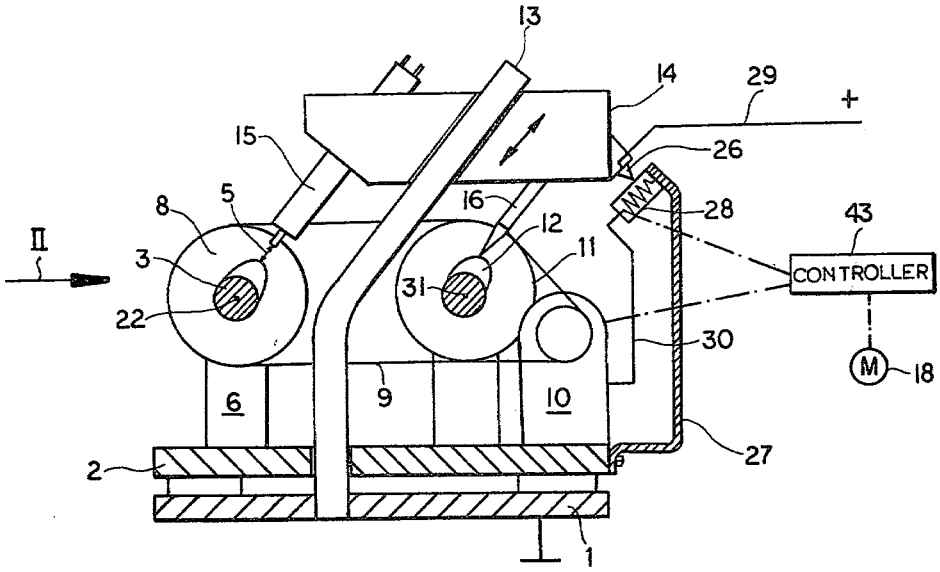
FIG. 1 is an end view through the machine for carrying out the method according to the instant invention.
Figure 2:
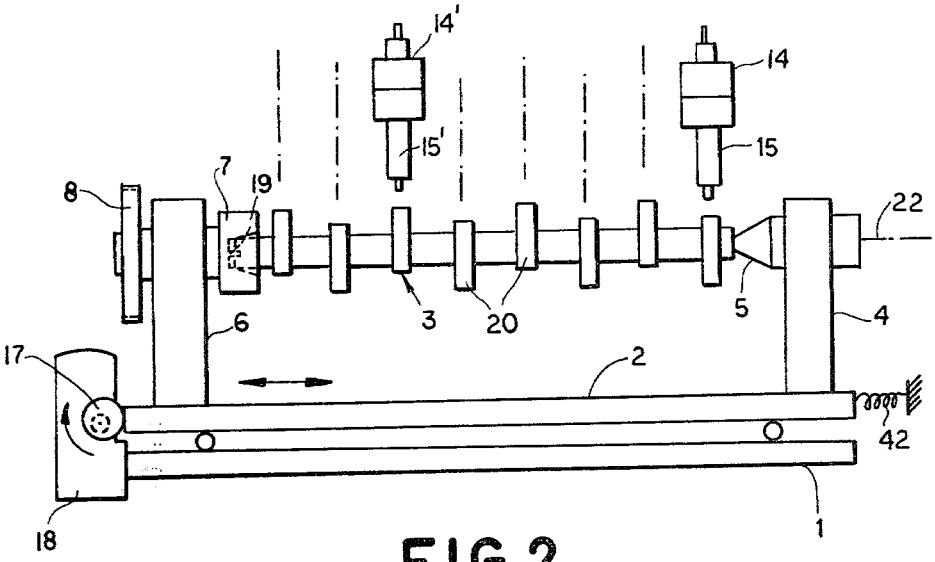
FIG. 2 is a view taken in the direction of arrow II of FIG. 1.
Figure 3:
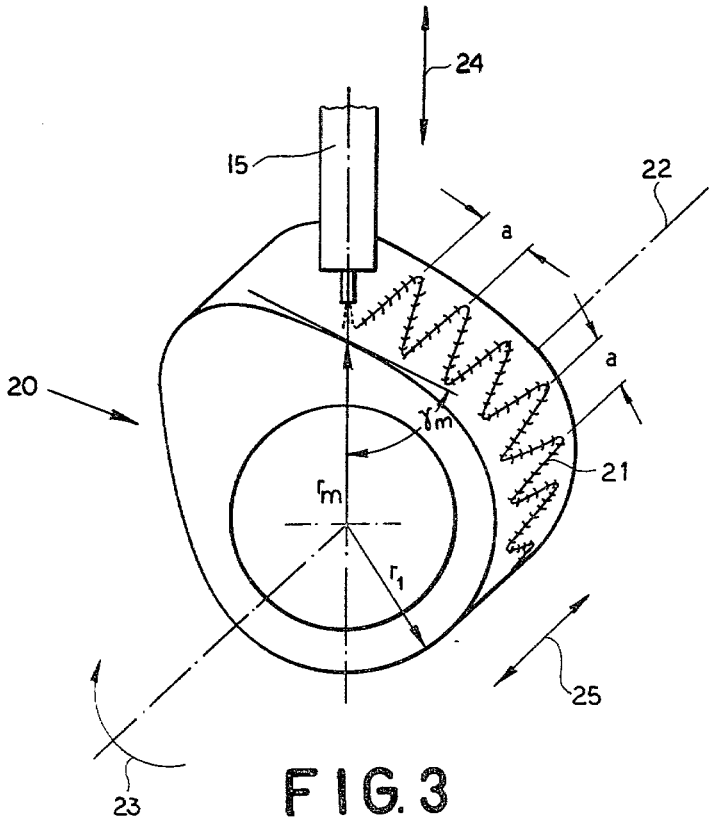
FIG. 3 is a large-scale and partly diagrammatic perspective view illustrating the operation of the system according to the instant invention.

As shown in FIGS. 1–3 the machine for carrying out the method according to the instant invention has a stationary base 1 on which a support plate 2 is displaceable parallel to an axis 22. The support plate 2 carries a tailstock 4 with a live center 5 for supporting one end of a workpiece 3 whose other end is held in a chuck 7 of a headstock 6. A formation 19 on the chuck 7 ensures that the workpiece 3, here a valve-lifting camshaft for a four-cylinder internal-combustion engine, is centered on the axis 22. A motor 10 drives a toothed belt 9 fitted over a pulley 8 connected to the chuck 7.

In addition the toothed belt 9 passes over a second drive pulley 11 which is connected in the same manner as the drive pulley 8 to a master or template camshaft 12 carried on structure identical to the structure 4–7 and also mounted on the plate for rotation of the camshaft 12 about an axis 31 directly parallel to the axis 22. The angular positions of the two camshafts 3 and 12 will be identical as will the angular rotation speeds.

A motor 18 carried on the base 1 engages the support plate 2 by means of a cam 17. A spring 42 ensures that the support plate 2 bears in the direction of axis 22 on the cam 17. This eccentric cam 17 therefore will axially reciprocate the support plate 2, and with it the camshafts 3 and 12, at a reciprocation rate or frequency determined by the speed at which the motor 18 is operated.

The base 1 carries a plurality, here eight, of guides 13 of which only one is visible in FIG. 1. This one guide 13 carries a slider 14 which has at its rear end a follower or feeler 16 radially directed at the axis 31 of the master camshaft 12 and at its front side a TIG torch 15 directed radially at the axis 22 of the front camshaft 3. Thus as the motor 10 rotates the two camshafts 3 and 12 synchronously at the same angular speed and in the same rotational sense the follower 16 will cause the torch 15 to remain at a perfectly fixed spacing s from the surface of the respective cam 20 of the camshaft 3. The other torches, of which one is shown at 15' with its slider 14', can be angularly offset or can be arranged parallel to the fully illustrated torch 15 and slider 14. The above-cited German utility model can be referred to for more details as to the above-described structure.

According to the instant invention the torch 15 as shown in FIG. 3 is intended to harden the surface of the respective cam 20 by moving over an undulating path illustrated at 21 on the surface of this cam 20. This is achieved by rotating the cam 20 about the axis 22 in the rotational direction indicated by arrow 23, while simultaneously displacing the torch 15 radially as indicated by arrow 24 to maintain the desired spacing s (FIG. 1), and also simultaneously relatively reciprocating the torch 15 and the cam 20 as illustrated by the axial arrow 25, this being achieved here by holding the torch 15 still and axially moving the cam 20.

It is the goal of the instant invention to maintain the pitch of the undulating path 21 relatively constant, or in other words to ensure that the crest-to-crest dimension a measured on the surface of the cam 20 is equal over the entire cam 20. This is done in accordance with one feature of the instant invention by varying the angular rotation rate about the axis 22 in the direction of arrow 23 in accordance with the following formula:

$$\omega_i=(r_{min}/r_i)\omega_{min}\sin\gamma_i$$

wherein:

- $\omega_i$ is the instantaneous angular speed of the object about the axis;
- $r_{min}$ is the radius of the surface at its regium of smallest (minimum) radius;
- $r_i$ is the instantaneous radius from the location juxtaposed with the heat source;
- $\omega_{min}$ is the angular speed of the object when the source is juxtaposed with the region of smallest radius; and
- $\gamma_i$ is the instantaneous angle between a plane tangent to the surface at the location juxtaposed with the source and a plane through the location and the axis.

It is also possible to obtain this end of uniform pitch of the sinusoidal path 21 by varying the frequency of axial reciprocation in the direction of arrow 25 in accordance with the following formula:

$$f_i=(r_i/r_{min})f_{min}/\sin\gamma_i$$

wherein:

- $f_i$ is the instantaneous axial reciprocation frequency between the object and the source;
- $r_i$ is the instantaneous radius from the location juxtaposed with the heat source;
- $f_{min}$ is the axial reciprocation frequency of the object and the source when the source is juxtaposed with the region of smallest diameter; and
- $\gamma_i$ is the instantaneous angle between a plane tangent to the surface at the location juxtaposed with the source and a plane through the location and the axis.

It is possible to achieve either of the above-formulated operations in accordance with the system of FIG. 1. Here the one slider 14 carries a wiper 26 of a potentiometer 28, with conductors 29 and 30 connecting this potentiometer 28 in series between the motor 10 and its power source. The potentiometer 28 is not of the linear type, but has a resistance/position characteristic which assures driving of the motor 10 in accordance with the first formula given above. Reversing the end of the potentiometer 28 to which the wire 30 is connected and connecting the wire 30 to the motor 18 instead of the motor 10 can similarly vary the frequency as shown in the second formula given above.

Figure 4:
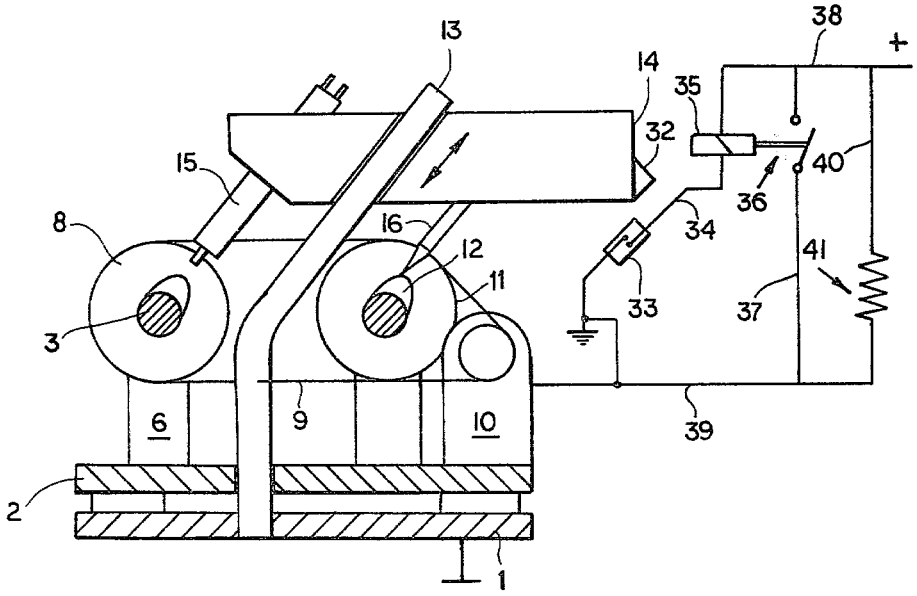
FIG. 4 is a view similar to FIG. 1 illustrating another arrangement according to this invention.

Alternately the slider 14 as shown in FIG. 4 can carry a magnet 32 capable of closing a reed switch 33 connected via a line 34 to a relay 35 in turn connected via line 38 to one side of the power source for the motor 10. The contacts 36 of this normally open relay 35 are connected in a line 37 across a line 40 having a resistor 41 and itself connected between the hot power-source line 38 and the line 39 leading to the motor 10. Thus when the magnet 32 is juxtaposed with the reed switch 33, in a radially inner position of the follower 16 and torch 15, the relay 35 will close to short out the resistor 41 and thereby increase the electric feed to the motor 10 to speed it up. Obviously the path of travel of the arrangement can be subdivided into several such zones if desired, each with a respective switch like the reed switch 33.

It is also possible to operate a controller 43 from the potentiometer 28 of FIG. 4. This controller 43 will be programmed to control the motor 10 or 18 in accordance with the appropriate formula. To this end the controller will know the slope or surface angle of each portion of the cam lobe 20 for the particular workpiece 3 in accordance with the radial distance of the surface portion being treated from the axis 22. Since the normal valve-lifter cams 20 are substantially symmetrical about planes passing through their axes, the radial distance from a given point on the surface can easily be related to the shape of that point by means of appropriate circuitry which is programmed with the basic shape.

The various torches are spaced angularly about the workpiece by angular offsets equal to the angular offsets of the respective cams. Thus the angular speed or reciprocation rate will be varied so that all the torches will uniformly harden their respective surfaces, since the same portions of all the cams will be juxtaposed with their respective torches at the same instant. Otherwise it is necessary to harden one cam at a time.

I claim:

1. A method of surface-hardening an object having an axis and an eccentric surface, said method comprising the steps of:

rotating said object about said axis at an angular speed rate;

juxtaposing a torch-type heat source with and directing same radially at said surface;

displacing said heat source radially of said axis relative to said eccentric surface during rotation thereof to hold said heat source at a substantially fixed radial distance from said surface;

relatively axially reciprocating said heat source and said object during rotation thereof at a reciprocation rate so that said heat source heats said surface along an undulating path; and varying one of said rates in such a manner that the pitch of said path remains substantially constant.

2. The method defined in claim 1 wherein said one rate is generally varied in dependence on the instantaneous radial distance between the location juxtaposed with said heat source and said axis.

3. The method defined in claim 2 wherein said one rate is the instantaneous angular speed $\omega_i$ of the object about the axis and is varied in accordance with the formula:

$$\omega_i=(r_{min}/r_i)\omega_{min}\sin\gamma_i$$

wherein:

$r_{min}$ is the radius of the surface at its region of smallest (minimum) radius;

$r_i$ is the instantaneous radius from the location juxtaposed with the heat source;

$\omega_{min}$ is the angular speed of the object when the source is juxtaposed with the region of smallest radius; and $\gamma_i$ is the instantaneous angle between a plane tangent to the surface at the location juxtaposed with the source and a plane through the location and the axis.

4. The method defined in claim 2 wherein said one rate is the instantaneous axial reciprocation frequency $f_i$ between the object and the source and is varied in accordance with the formula:

$$f_i=(r_i/r_{min})f_{min}/\sin\gamma_i$$

wherein:

$r_{min}$ is the radius of the surface at its region of smallest (minimum) radius;

$r_i$ is the instantaneous radius from the location juxtaposed with the heat source;

$f_{min}$ is the axial reciprocation frequency of the object and the source when the source is juxtaposted with the region of smallest diameter; and $\gamma_i$ is the instantaneous angle between a plane tangent to the surface at the location juxtaposed with the source and a plane through the location and the axis.

5. The method defined in claim 1 wherein said object is a camshaft having a plurality of cams, each cam having one such surface.

* * * * *